US012656077B2

(12) United States Patent
McPherson

(10) Patent No.: US 12,656,077 B2
(45) Date of Patent: Jun. 16, 2026

(54) ARCHERY BOW WITH CENTERED CABLE GUARD

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 18/582,403

(22) Filed: Feb. 20, 2024

(65) Prior Publication Data

US 2024/0191964 A1 Jun. 13, 2024

Related U.S. Application Data

(63) Continuation of application No. 17/246,166, filed on Apr. 30, 2021, now Pat. No. 11,906,262.

(60) Provisional application No. 63/019,216, filed on May 1, 2020.

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01)

(58) Field of Classification Search
CPC ..... F41B 5/10; F41B 5/14; F41B 5/1403
USPC ..... 124/25.6, 86, 88
See application file for complete search history.

(56) References Cited

U.S. PATENT DOCUMENTS 4,061,125 A * 12/1977 Trotter ..... F41B 5/14 124/88
4,203,412 A * 5/1980 Rickard ..... F41B 5/105 124/90
4,207,858 A * 6/1980 Blackstone ..... F41B 5/105 124/90
4,377,152 A * 3/1983 Saunders ..... F41B 5/14 124/87
4,452,222 A * 6/1984 Quartino ..... F41B 5/10 124/88
4,461,267 A * 7/1984 Simonds ..... F41B 5/105 124/900
4,542,591 A * 9/1985 Montgomery ..... F41G 1/467 124/87
4,542,732 A 9/1985 Troncoso
4,596,228 A * 6/1986 Smith ..... F41B 5/10 124/88
4,628,892 A * 12/1986 Windedahl ..... F41B 5/1407 124/92
4,819,611 A * 4/1989 Sappington ..... F41G 1/467 124/87
4,834,061 A * 5/1989 Chattin ..... F41B 5/1426 124/88
4,886,038 A * 12/1989 Betters ..... F41B 5/10 124/88

(Continued)

*Primary Examiner* — Alexander R Niconovich
(74) *Attorney, Agent, or Firm* — Laabs Intellectual Property

(57) ABSTRACT

In some embodiments, an archery bow comprises a riser comprising a grip, a bowstring comprising a nocking point, a cable and a cable guard arranged to apply a force to the cable at a contact location. The bow defines a shooting axis, which is positioned in a longitudinal plane and a lateral plane. The longitudinal plane is orthogonal to the lateral plane. The bowstring is positioned in the longitudinal plane. The contact location is positioned on the lateral plane.

17 Claims, 13 Drawing Sheets

(56) References Cited

U.S. PATENT DOCUMENTS 4,903,678 A * 2/1990 Walker ..... F41B 5/10 124/90
4,917,070 A * 4/1990 Townsend ..... F41B 5/10 124/88
4,919,108 A * 4/1990 Larson ..... F41B 5/10 124/88
5,002,035 A * 3/1991 Brooks ..... F41B 5/1469 124/35.2
5,081,980 A * 1/1992 Newbold ..... F41B 5/1438 124/44.5
5,103,798 A * 4/1992 McGraw ..... F41B 5/14 124/88
5,161,514 A * 11/1992 Cary ..... F41B 5/143 124/44.5
5,178,122 A * 1/1993 Simonds ..... F41B 5/10 124/88
5,323,756 A 6/1994 Rabska
5,368,006 A * 11/1994 McPherson ..... F41B 5/10 124/900
5,392,757 A * 2/1995 Head ..... F41B 5/14 124/25.6
5,415,149 A * 5/1995 Derus ..... F41B 5/14 124/88
5,433,792 A * 7/1995 Darlington ..... F41B 5/10 124/88
5,452,704 A * 9/1995 Winebarger ..... F41B 5/1407 124/92
5,490,492 A * 2/1996 Savage ..... F41B 5/143 124/44.5
5,553,597 A * 9/1996 Sparks ..... F41B 5/1438 124/44.5
5,553,600 A * 9/1996 Miller ..... F41B 5/10 124/25.6
5,555,874 A 9/1996 Savage
5,651,355 A * 7/1997 Gallops, Jr. ..... F41B 5/10 124/86
5,718,213 A * 2/1998 Gallops, Jr ..... F41B 5/10 124/86
5,720,269 A * 2/1998 Saunders ..... F41B 5/1407 124/25.6
5,722,385 A * 3/1998 Bunk ..... F41B 5/10 124/25.6
5,791,324 A * 8/1998 Johnson ..... F41B 5/10 124/90
D412,021 S 7/1999 Gray
5,983,880 A * 11/1999 Saunders ..... F41B 5/10 124/25.6
6,098,607 A 8/2000 Strother
6,152,124 A * 11/2000 Gallops, Jr. ..... F41B 5/10 124/86
6,178,958 B1 * 1/2001 Gallops, Jr. ..... F41B 5/10 124/25.6
6,382,201 B1 5/2002 McPherson et al.
6,425,385 B1 * 7/2002 Gallops, Jr. ..... F41B 5/10 124/86
6,443,139 B1 * 9/2002 McPherson ..... F41B 5/105 124/25.6
6,532,945 B1 * 3/2003 Chattin ..... F41B 5/10 124/86
6,550,467 B2 * 4/2003 Gallops, Jr. ..... F41B 5/1407 124/86
6,634,348 B2 * 10/2003 Gallops, Jr. ..... F41B 5/1426 124/86
6,655,371 B2 12/2003 Gallops, Jr.
6,681,753 B2 * 1/2004 Afshari ..... F41B 5/143 124/44.5
6,681,754 B1 * 1/2004 Angeloni ..... F41B 5/143 124/44.5
6,708,684 B2 * 3/2004 Chattin ..... F41B 5/1426 124/25.6
6,715,479 B1 * 4/2004 Bunk ..... F41B 5/10 124/25.6
6,722,354 B1 * 4/2004 Land ..... F41B 5/10 124/25.6
6,745,756 B1 6/2004 Achkar
6,889,679 B2 * 5/2005 Chattin ..... F41B 5/10 124/86
6,904,900 B2 * 6/2005 Gallops, Jr. ..... F41B 5/10 124/44.5
6,966,314 B2 * 11/2005 McPherson ..... F41B 5/1426 124/89
7,100,591 B2 * 9/2006 Terry ..... F41B 5/143 124/44.5
7,958,881 B2 * 6/2011 Silverson ..... F41B 5/14 124/88
8,028,685 B2 * 10/2011 Clark ..... F41B 5/10 124/25.6
8,176,906 B2 * 5/2012 Simo ..... F41B 5/10 124/25.6
8,307,816 B2 * 11/2012 Darlington ..... F41B 5/14 124/90
8,371,283 B2 * 2/2013 Grace ..... F41B 5/14 124/90
8,402,960 B2 * 3/2013 McPherson ..... F41B 5/14 124/90
8,424,511 B2 * 4/2013 Grace, Jr. ..... F41B 5/14 124/88
8,485,169 B2 * 7/2013 Dahl, II ..... F41B 5/105 124/25.6
8,616,189 B2 * 12/2013 McPherson ..... F41B 5/10 124/88
8,622,050 B2 * 1/2014 Goff ..... F41B 5/12 124/35.2
8,651,097 B2 2/2014 Grace, Jr. et al.
8,746,219 B2 * 6/2014 Anselmo ..... F41B 5/10 124/25.6
8,784,628 B2 * 7/2014 Grace, Jr. ..... F41B 5/1403 204/488
8,813,737 B2 * 8/2014 Langley ..... F41B 5/1403 124/88
8,925,536 B2 * 1/2015 Derus ..... F41B 5/10 124/25.6
8,950,388 B2 * 2/2015 McPherson ..... F41B 5/10 124/88
9,285,179 B2 * 3/2016 Prater ..... F41B 5/1403
9,291,422 B1 * 3/2016 Gold ..... F41B 5/1403
9,303,946 B2 4/2016 McPherson
9,581,408 B2 * 2/2017 Prater ..... F41B 5/148
9,829,269 B2 * 11/2017 McPherson ..... F41B 5/10
9,958,231 B2 * 5/2018 McPherson ..... F41B 5/1469
9,989,329 B2 * 6/2018 Kelly ..... F41B 5/1403
10,048,038 B1 * 8/2018 Darlington ..... F41B 5/1403
10,066,895 B2 * 9/2018 Yehle ..... F41B 5/10
10,082,358 B2 * 9/2018 McPherson ..... F41B 5/105
10,175,024 B2 * 1/2019 Walthert ..... F41B 5/1403
10,488,144 B2 * 11/2019 Hughes ..... F41B 5/1403
2003/0136392 A1 7/2003 McPherson
2008/0127961 A1 6/2008 McPherson
2009/0107474 A1 * 4/2009 Silverson ..... F41B 5/14 124/88
2009/0145411 A1 * 6/2009 Sims ..... F41B 5/10 29/428
2010/0101549 A1 4/2010 Grace et al.
2010/0132685 A1 * 6/2010 De Sousa ..... F41B 5/14 124/88
2010/0224178 A1 * 9/2010 McPherson ..... F41B 5/1426 124/88
2010/0282226 A1 * 11/2010 Marzullo ..... F41B 5/14 124/1
2010/0319670 A1 * 12/2010 Sims ..... F41B 5/1426 124/89
2011/0011385 A1 1/2011 Grace, Jr. et al.
2011/0073090 A1 3/2011 McPherson
2011/0192385 A1 8/2011 Clark
2011/0247602 A1 * 10/2011 McPherson ..... F41B 5/1403 124/88
2011/0303204 A1 * 12/2011 Gordon ..... F41B 5/1426 124/88
2012/0042861 A1 2/2012 Anselmo

(56) References Cited

U.S. PATENT DOCUMENTS

| | | | | |
|---|---|---|---|---|
| 2012/0042864 | A1 | 2/2012 | McPherson | |
| 2012/0204851 | A1 | 8/2012 | McPherson et al. | |
| 2012/0272939 | A1 | 11/2012 | Grace, Jr. et al. | |
| 2013/0055997 | A1* | 3/2013 | Badgerow | F41B 5/1403 124/88 |
| 2013/0061838 | A1* | 3/2013 | Gordon | F41B 5/14 124/88 |
| 2014/0190461 | A1* | 7/2014 | Sims | F41B 5/123 124/25.6 |
| 2014/0299116 | A1 | 10/2014 | Yehle | |
| 2015/0027425 | A1 | 1/2015 | Yehle | |
| 2015/0192381 | A1* | 7/2015 | Yi | F41B 5/105 124/25.6 |
| 2016/0025443 | A1* | 1/2016 | Valsecchi | F41B 5/148 124/23.1 |
| 2016/0061556 | A1* | 3/2016 | Armstrong | F41B 5/1426 124/89 |
| 2022/0136794 | A1* | 5/2022 | McPherson | F41B 5/1403 124/25.6 |

* cited by examiner

ARCHERY BOW WITH CENTERED CABLE GUARD

CROSS-REFERENCE TO RELATED APPLICATIONS

This application claims the benefit of U.S. patent application Ser. No. 17/246,166, filed Apr. 30, 2021, which claims the benefit of U.S. Patent Application No. 63/019,216, filed May 1, 2020, the entire content of which is hereby incorporated herein by reference.

BACKGROUND OF THE INVENTION

This invention relates to archery bows, which are known in the art and are used to launch projectiles, such as arrows.

In an archery bow, the energy that is transferred to the arrow during firing ultimately comes from the archer. The process of drawing the bow transfers energy from the archer to the bow. The stored energy is largely transferred to the arrow, but some energy is lost due to various inefficiencies in the bow.

There remains a need for novel archery bow designs that provide benefits in efficiency and accuracy over prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

SUMMARY OF THE INVENTION

In some embodiments, an archery bow comprises a riser comprising a grip, a bowstring comprising a nocking point, a cable and a cable guard arranged to apply a force to the cable at a contact location. The bow defines a shooting axis, which is positioned in a longitudinal plane and a lateral plane. The longitudinal plane is orthogonal to the lateral plane. The bowstring is positioned in the longitudinal plane. The contact location is positioned on the lateral plane.

In some embodiments, the cable guard comprises a body member attached to the riser. In some embodiments, a longitudinal axis of the body member is oriented nonparallel to the shooting axis.

In some embodiments, the cable guard comprises a cable engaging member arranged to move with respect to the body member. In some embodiments, the cable guard comprises a roller arranged to contact the cable.

In some embodiments, the riser comprises a cavity and a portion of the body member is oriented in the cavity. In some embodiments, the cavity comprises a central axis oriented nonparallel to the shooting axis. In some embodiments, the cavity is defined by an arcuate sidewall.

In some embodiments, the bow comprises a second cable and the cable guard applies a force to the second cable.

In some embodiments, the cable guard comprises a first roller and a second roller, the first roller comprising a different diameter from the second roller.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF DRAWINGS

A detailed description of the invention is hereafter described with specific reference being made to the drawings.

DETAILED DESCRIPTION OF THE INVENTION

Figure 1:
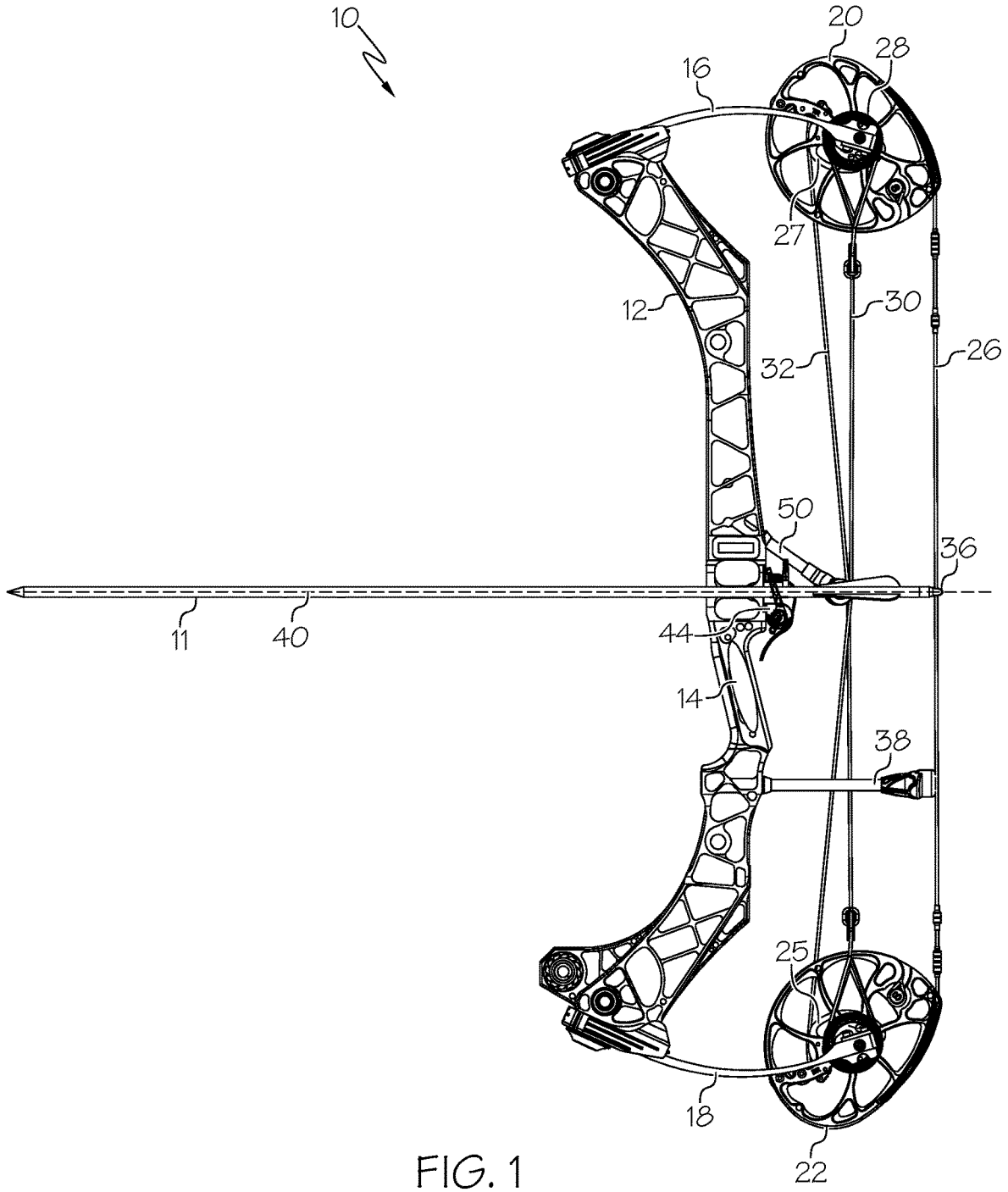
FIG. 1 shows a side view of an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
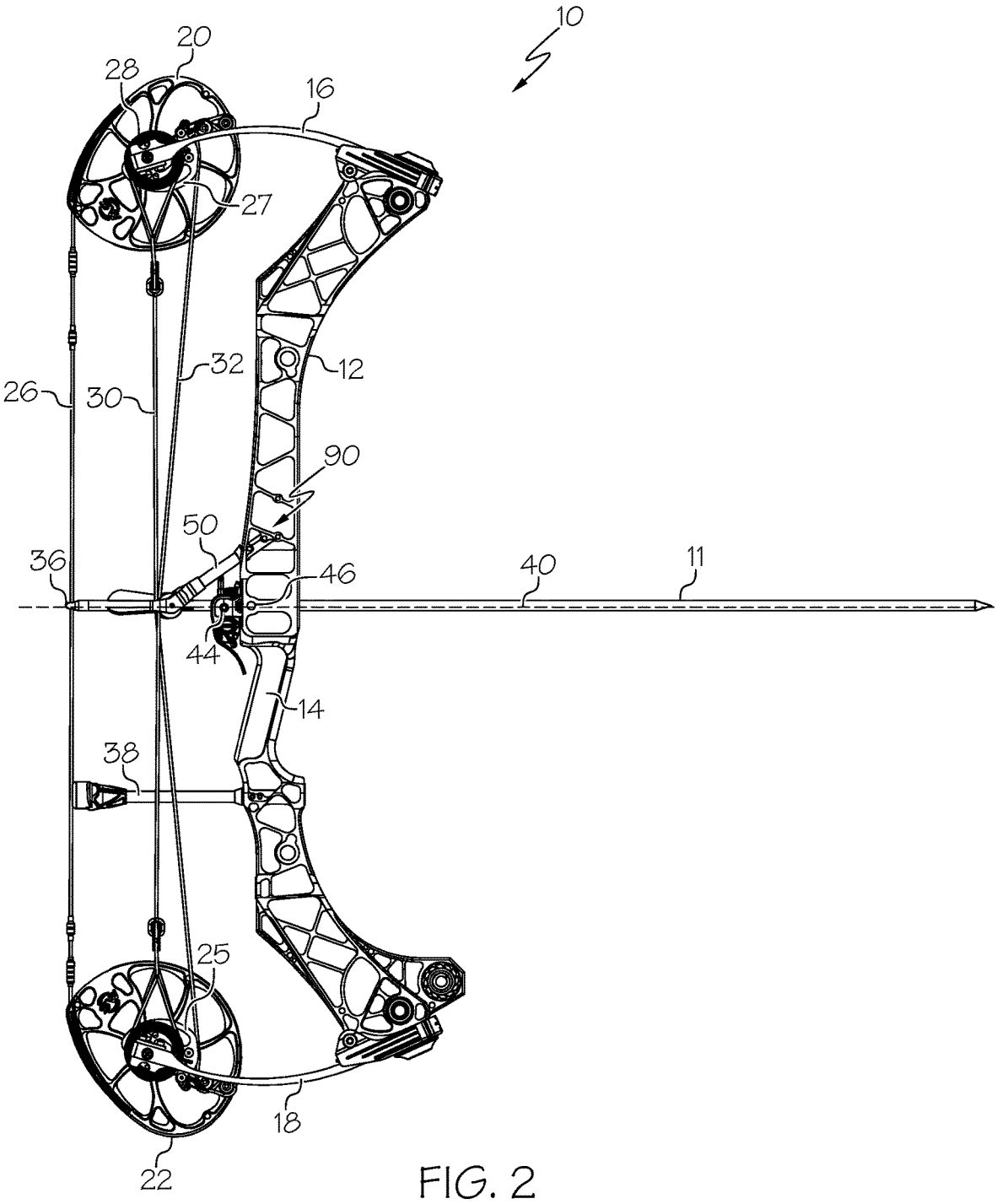
FIG. 2 shows an opposite side view of the bow of FIG. 1.
Figure 3:
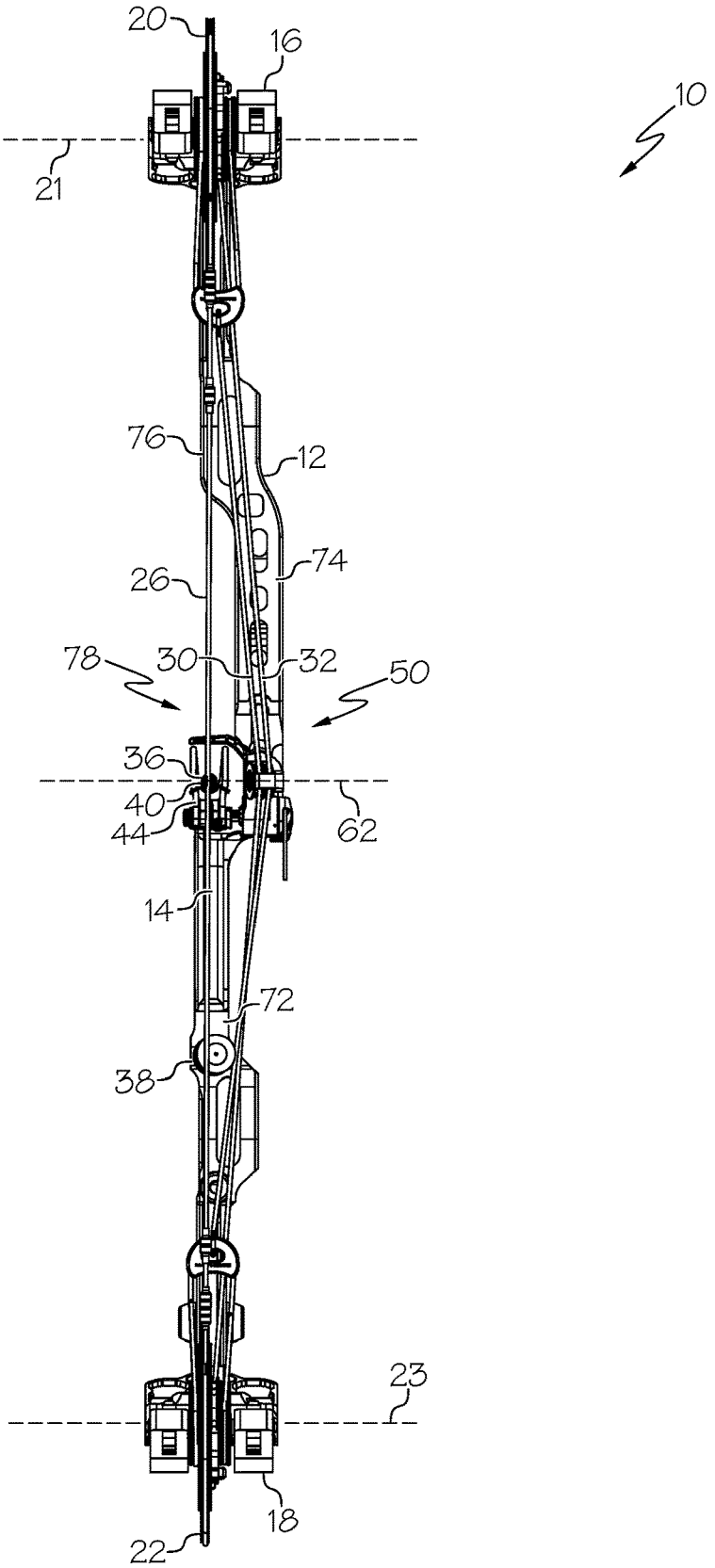
FIG. 3 shows a back view of the bow of FIG. 1.

FIG. 1 shows an embodiment of an archery bow 10. FIG. 2 shows an opposite side view of the embodiment of the archery bow 10. FIG. 3 shows a back view of the embodiment of the archery bow 10.

In some embodiments, an archery bow 10 comprises a riser 12, a first limb 16 arranged to support a first rotatable member 20 and a second limb 18 arranged to support a second rotatable member 22. In some embodiments, a bowstring 26 extends between the first rotatable member 20 and the second rotatable member 22. In some embodiments, an archery bow 10 comprises a compound bow comprising a first cable 30. In some embodiments, the first cable 30 is attached to the second rotatable member 22 and arranged to be taken up by a cam track 25 as the bow 10 is drawn. In some embodiments, the second rotatable member 22 comprises the cam track 25. In some embodiments, the first cable 30 comprises a power cable. In some embodiments, the first cable 30 is also attached to the first rotatable member 20. In some embodiments, the first cable 30 is attached to the first rotatable member 20 by a force vectoring anchor 28, for example as disclosed in U.S. Pat. No. 8,020,544, or by an unspooling anchor (not shown), for example as disclosed in U.S. Pat. No. 6,990,970.

In some embodiments, the archery bow 10 comprises a second cable 32. In some embodiments, the second cable 32 is attached to the first rotatable member 20 and arranged to be taken up by a second cam track 27 as the bow 10 is drawn.

In some embodiments, the first rotatable member 20 comprises the second cam track 27. In some embodiments, the second cable 32 comprises a second power cable. In some embodiments, the second cable 32 is attached to the second rotatable member 22. In some embodiments, the second rotatable member 22 is shaped according to a mirror image of the first rotatable member 20. In some embodiments, the configuration of the second cable 32 comprises a mirror of the first cable 30.

In some embodiments, the archery bow 10 comprises a single cam or cam-and-a-half bow (not shown) and the second cable 32 comprises a secondary bowstring segment or a control cable.

In some embodiments, the riser 12 comprises a grip 14. In some embodiments, a longitudinal axis of the grip 14 is parallel to a longitudinal axis of the riser 12.

Desirably, the archery bow 10 defines a shooting axis 40. In some embodiments, an arrow 11 is generally launched along the shooting axis 40 when fired from the bow 10. In some embodiments, the bowstring 26 comprises a nocking point 36. In some embodiments, the nocking point 36 engages the arrow 11. In some embodiments, the nocking point 36 traverses along the shooting axis 40 as the bowstring 26 is drawn and/or released.

In some embodiments, the archery bow 10 comprises an arrow rest 44. In some embodiments, an arrow rest 44 is attached to the riser 12. In some embodiments, an arrow rest 44 supports an arrow 11 and aligns the arrow 11 upon the shooting axis 40. In some embodiments, the riser 12 comprises a dovetail and an arrow rest 44 is configured to attach to the dovetail. In some embodiments, the riser 12 comprises a Berger button hole 46, which can be used for attaching an arrow rest 44.

In some embodiments, the archery bow 10 comprises a string stop 38. In some embodiments, a string stop 38 is attached to the riser 12. In some embodiments, a string stop 38 is positioned to contact the bowstring 26 when an arrow 11 is fired.

In some embodiments, the archery bow 10 comprises a cable guard 50. In some embodiments, a cable guard 50 is attached to the riser 12. In some embodiments, the cable guard 50 is arranged to apply a force to the first cable 30 and to apply a force to the second cable 32. In some embodiments, the cable guard 50 is arranged to bias the first cable 30 and the second cable 32 in a lateral direction. In some embodiments, the cable guard 50 is arranged to displace the first cable 30 and the second cable 32 laterally away from the shooting axis 40. In some embodiments, a cable guard 50 is arranged to displace the first cable 30 and the second cable 32 away from the riser 12, for example as disclosed in U.S. Pat. No. 8,402,960.

In some embodiments, the cable guard 50 contacts the first cable 30 at a location that is aligned with the shooting axis 40. In some embodiments, the cable guard 50 contacts the second cable 32 at a location that is aligned with the shooting axis 40.

Figure 4:
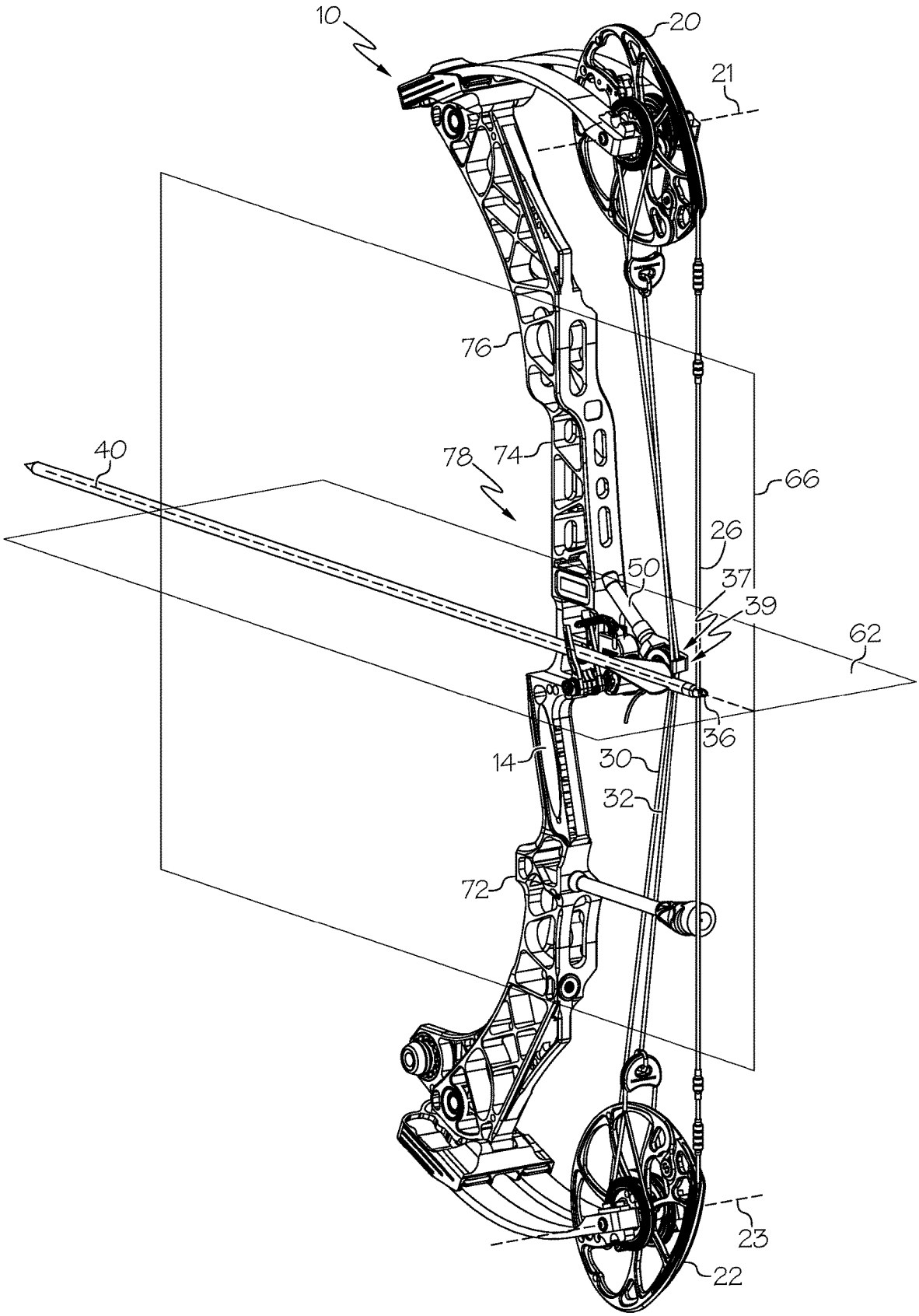
FIGS. 4 and 5 show additional views of the bow of FIG. 1.
Figure 5:
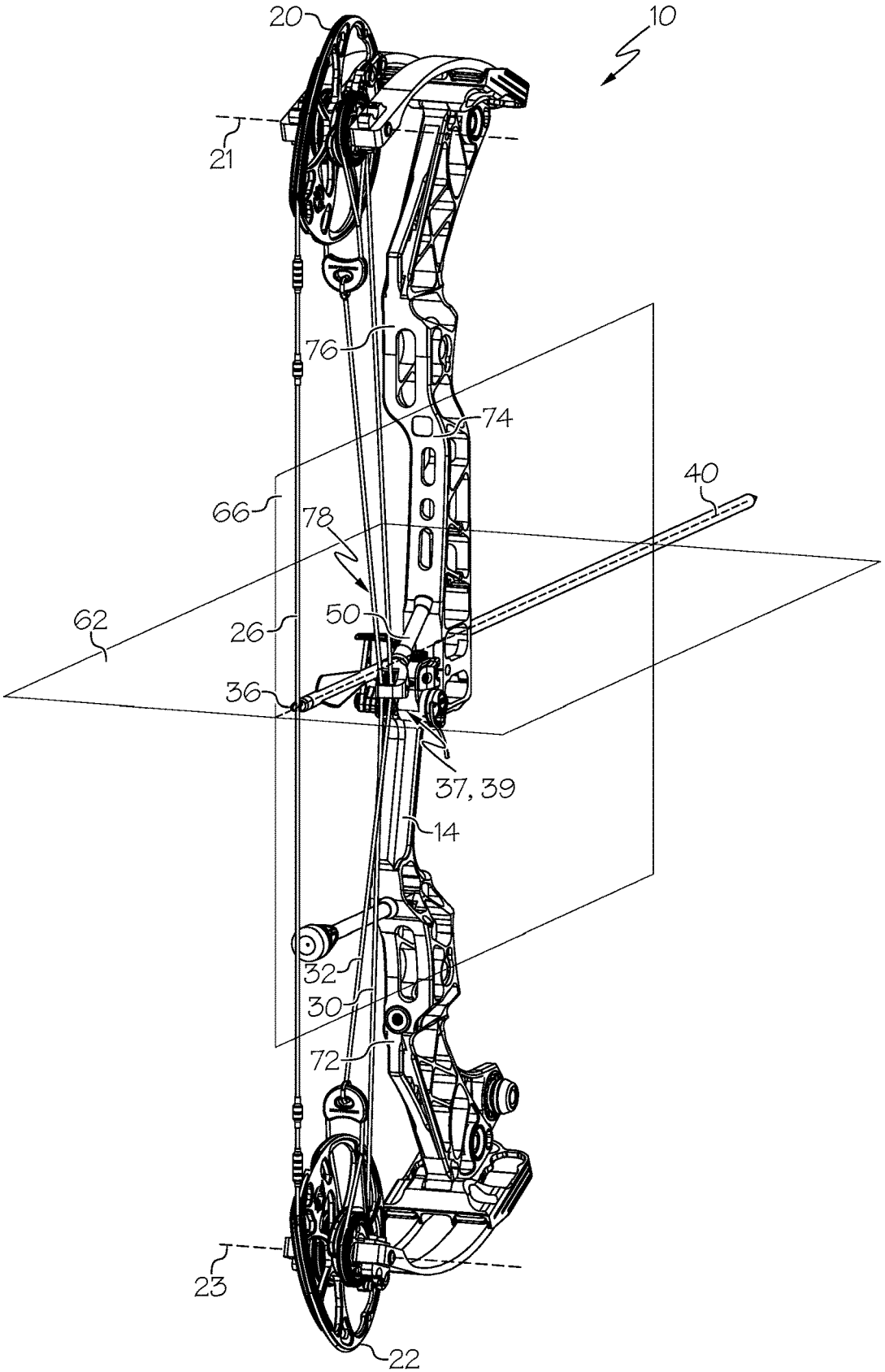

FIGS. 4 and 5 show additional views of the embodiment of the archery bow 10 shown in FIG. 1. In some embodiments, the archery bow 10 defines a longitudinal plane 66. In some embodiments, the longitudinal plane 66 is a reference plane that extends in the lengthwise direction of the archery bow 10. In some embodiments, the longitudinal plane 66 is oriented vertically when the archery bow 10 is properly oriented for shooting. In some embodiments, the shooting axis 40 is oriented in the longitudinal plane 66. In some embodiments, the bowstring 26 is oriented in the longitudinal plane 66. In some embodiments, the bowstring 26 sweeps along the longitudinal plane 66 as the bowstring 26 is drawn. In some embodiments, a longitudinal axis of the grip 14 is oriented in the longitudinal plane 66. In some embodiments, the cable guard 50 biases the first cable 30 and the second cable 32 away from the longitudinal plane 66.

In some embodiments, the archery bow 10 defines a lateral plane 62. In some embodiments, the lateral plane 62 is a reference plane that extends in the width direction of the archery bow 10. In some embodiments, the lateral plane 62 is oriented horizontally when the archery bow 10 is properly oriented for shooting. In some embodiments, the lateral plane 62 is oriented orthogonal to the longitudinal plane 66. In some embodiments, the shooting axis 40 is oriented in the lateral plane 62. In some embodiments, the shooting axis 40 comprises an intersection of the longitudinal plane 66 and the lateral plane 62.

In some embodiments, the cable guard 50 is arranged to contact the first cable 30 at a first contact location 37. In some embodiments, the first contact location 37 is oriented in the lateral plane 62. In some embodiments, the cable guard 50 is arranged to contact the second cable 32 at a second contact location 39. In some embodiments, the second contact location 39 is oriented in the lateral plane 62.

In some embodiments, the first rotatable member 20 is arranged to rotate about a first rotatable member axis 21. In some embodiments, the first rotatable member axis 21 is oriented parallel to the lateral plane 62. In some embodiments, the second rotatable member 22 is arranged to rotate about a second rotatable member axis 23. In some embodiments, the second rotatable member axis 23 is oriented parallel to the lateral plane 62. In some embodiments, the lateral plane 62 is located midway between the first rotatable member axis 21 and the second rotatable member axis 23. In some embodiments, a distance from the first rotatable member axis 21 to the lateral plane 62 is equal to a distance from the lateral plane 62 to the second rotatable member axis 23.

In some embodiments, the riser 12 comprises a first portion 72 and a second portion 74. In some embodiments, the second portion 74 is offset from the first portion 72. In some embodiments, the riser 12 comprises a third portion 76. In some embodiments, the third portion 76 is aligned with the first portion 72 and offset from the second portion 74. In some embodiments, the first portion 72 comprises a grip 14. In some embodiments, the first portion 72 is aligned with the longitudinal plane 66. In some embodiments, the third portion 76 is aligned with the longitudinal plane 66. In some embodiments, the second portion 74 is offset from the longitudinal plane 66. In some embodiments, the riser 12 defines a sight window 78. In some embodiments, the sight window 78 comprises a cavity. In some embodiments, the sight window 78 is aligned with the longitudinal plane 66. In some embodiments, the sight window 78 extends adjacent to the second portion 74. In some embodiments, a cable guard 50 is attached to the second portion 74 of the riser 12.

Figure 6:
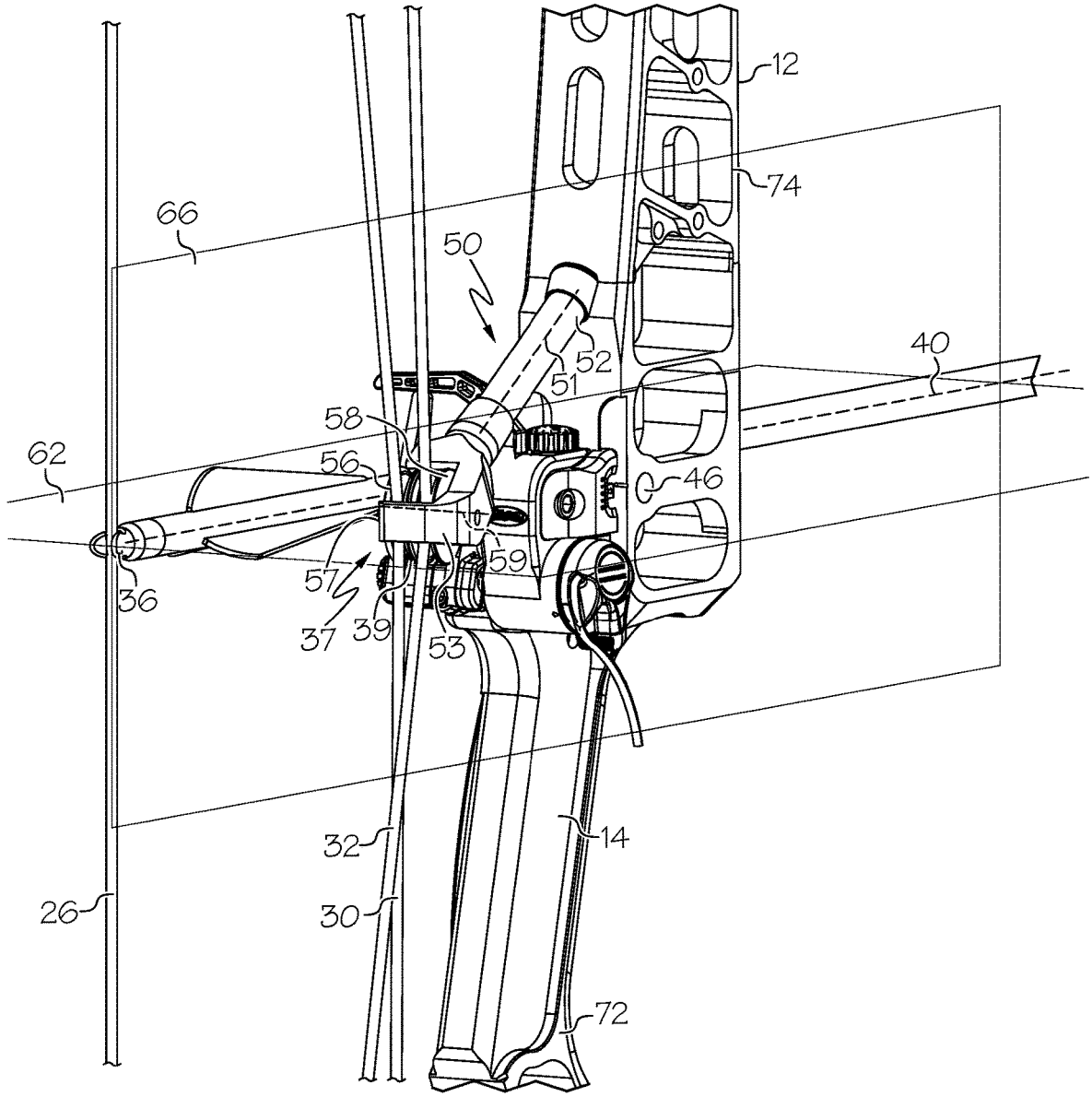
FIGS. 6 and 7 show an embodiment of a cable guard in greater detail.
Figure 7:
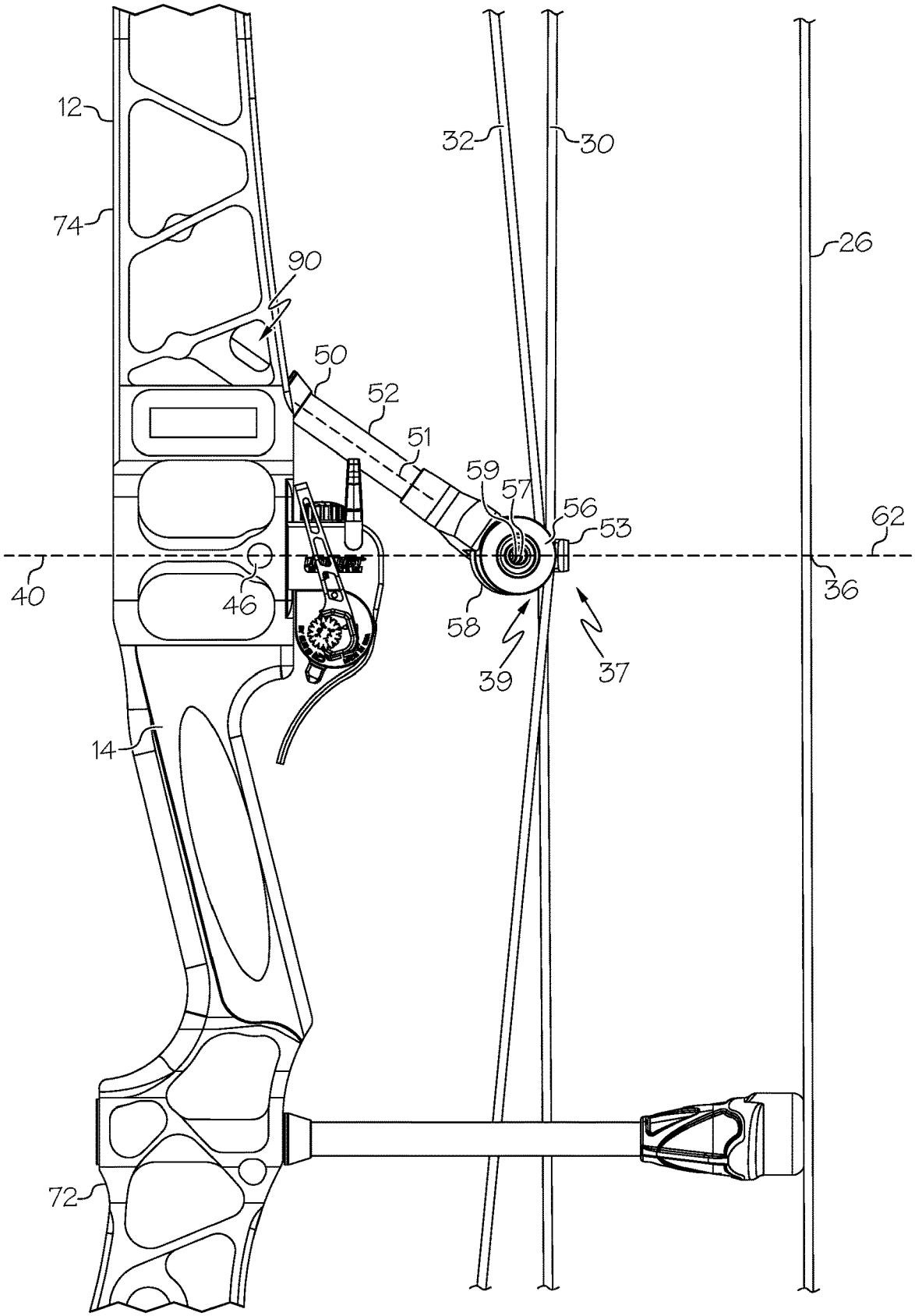

FIGS. 6 and 7 show an embodiment of a cable guard 50 in greater detail. In some embodiments, a cable guard 50 comprises a body 52 attached to the riser 12. In some embodiments, the riser 12 comprises a cavity and a portion of the body 52 is positioned in the cavity. In some embodiments, the cable guard 50 applies a force to the first cable 30 and second cable 32 and displaces the first cable 30 and the second cable 32 in a lateral direction.

In some embodiments, the cable guard 50 contacts the first cable 30 at a first contact location 37. In some embodiments, the first contact location 37 is oriented upon the lateral plane 62. In some embodiments, the cable guard 50 applies a force to the first cable 30, and a vector of the force is oriented in the lateral plane 62. In some embodiments, the cable guard 50 contacts the second cable 32 at a second contact location 39. In some embodiments, the second contact location 39 is oriented upon the lateral plane 62. In some embodiments, the cable guard 50 applies a force to the second cable 32, and a vector of the force is oriented in the lateral plane 62.

In some embodiments, the cable guard 50 comprises a first roller 56 arranged to contact the first cable 30. In some embodiments, the first roller 56 is arranged to rotate about a first roller axis 57. In some embodiments, the first roller axis 57 is oriented in the lateral plane 62. In some embodiments, the cable guard 50 comprises a second roller 58 arranged to contact the second cable 32. In some embodiments, the second roller 58 is arranged to rotate about a second roller axis 59. In some embodiments, the second roller axis 59 is oriented in the lateral plane 62. In some embodiments, the first roller axis 57 is parallel to the second roller axis 59. In some embodiments, the first roller axis 57 is collinear with the second roller axis 59.

In some embodiments, the cable guard 50 comprises a housing 53 arranged to surround the roller(s) 56, 58. In some embodiments, the housing 53 is arranged to capture the first cable 30 retain the first cable 30 in a groove defined in the first roller 56. In some embodiments, the housing 53 is arranged to capture the second cable 32 and retain the second cable 32 in a groove defined in the second roller 58.

In some embodiments, the cable guard 50 is attached to the riser 12 at a location that is offset from the lateral plane 62. In some embodiments, the cable guard 50 is attached to the riser 12 at a location that is offset from the longitudinal plane 66. In some embodiments, the body 52 comprises a shaft. In some embodiments, the body 52 comprises a longitudinal axis 51. In some embodiments, the longitudinal axis 51 is offset from the longitudinal plane 66. In some embodiments, the longitudinal axis 51 extends parallel to the longitudinal plane 66. In some embodiments, the longitudinal axis 51 is oriented nonparallel to the shooting axis 40. In some embodiments, the longitudinal axis 51 is centered upon the width of the second portion 74 of the riser 12.

A body member 52 of a cable guard 50 can be located at any suitable angle to the lateral plane 62. In various embodiments, an angle between the longitudinal axis 51 of the body member 52 and the lateral plane 62 can range from zero degrees to ninety degrees. In some embodiments, the angle ranges from 10 degrees to 80 degrees. In some embodiments, the angle ranges from 40 to 50 degrees.

In some embodiments, a body member 52 of a cable guard 50 can be located at any suitable angle to the longitudinal plane 66.

In some embodiments, the riser 12 comprises a Berger button hole 46. In some embodiments, the Berger button hole 46 is oriented on the lateral plane 62.

Figure 8:
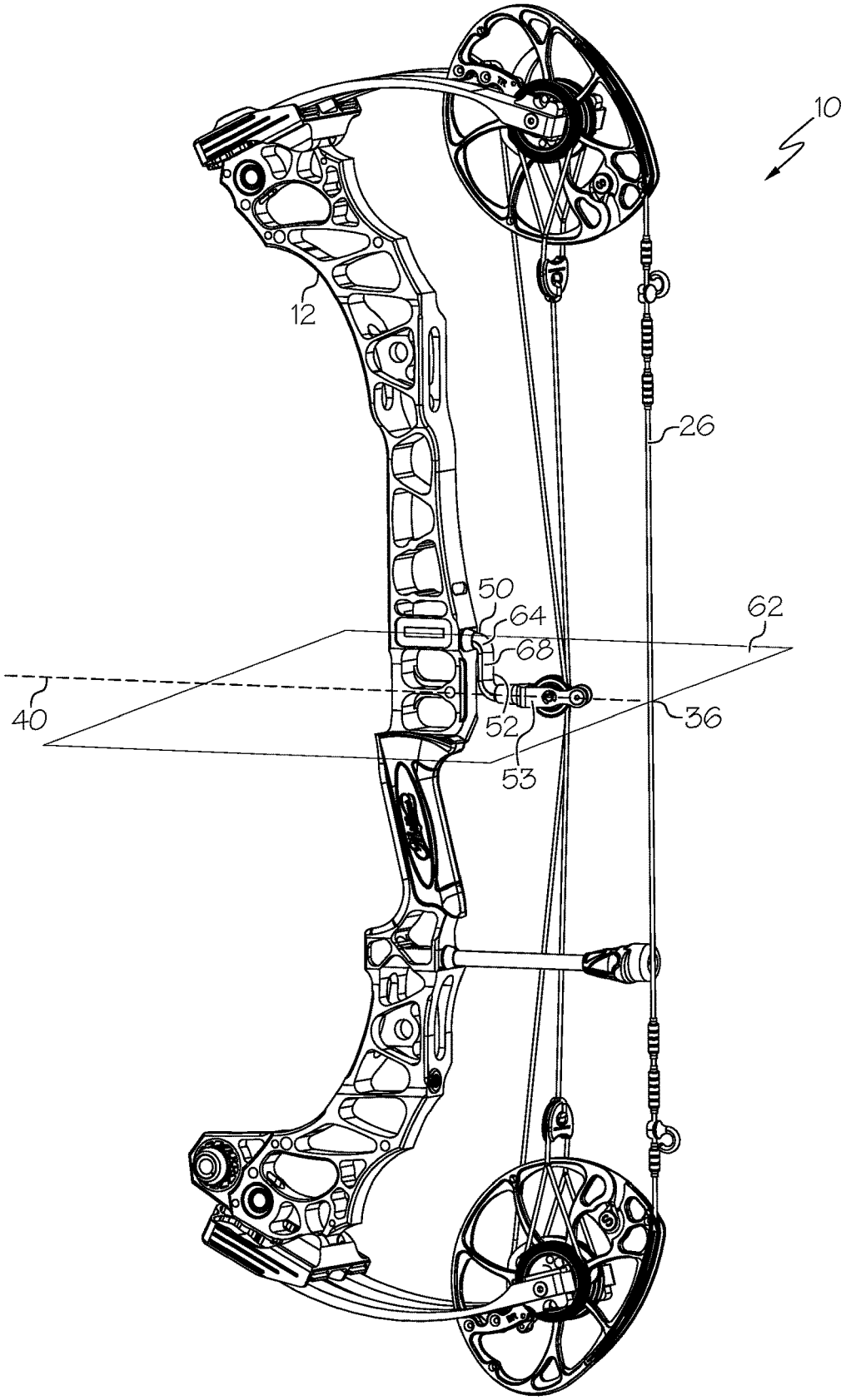
FIG. 8 shows another embodiment of an archery bow.
Figure 9:
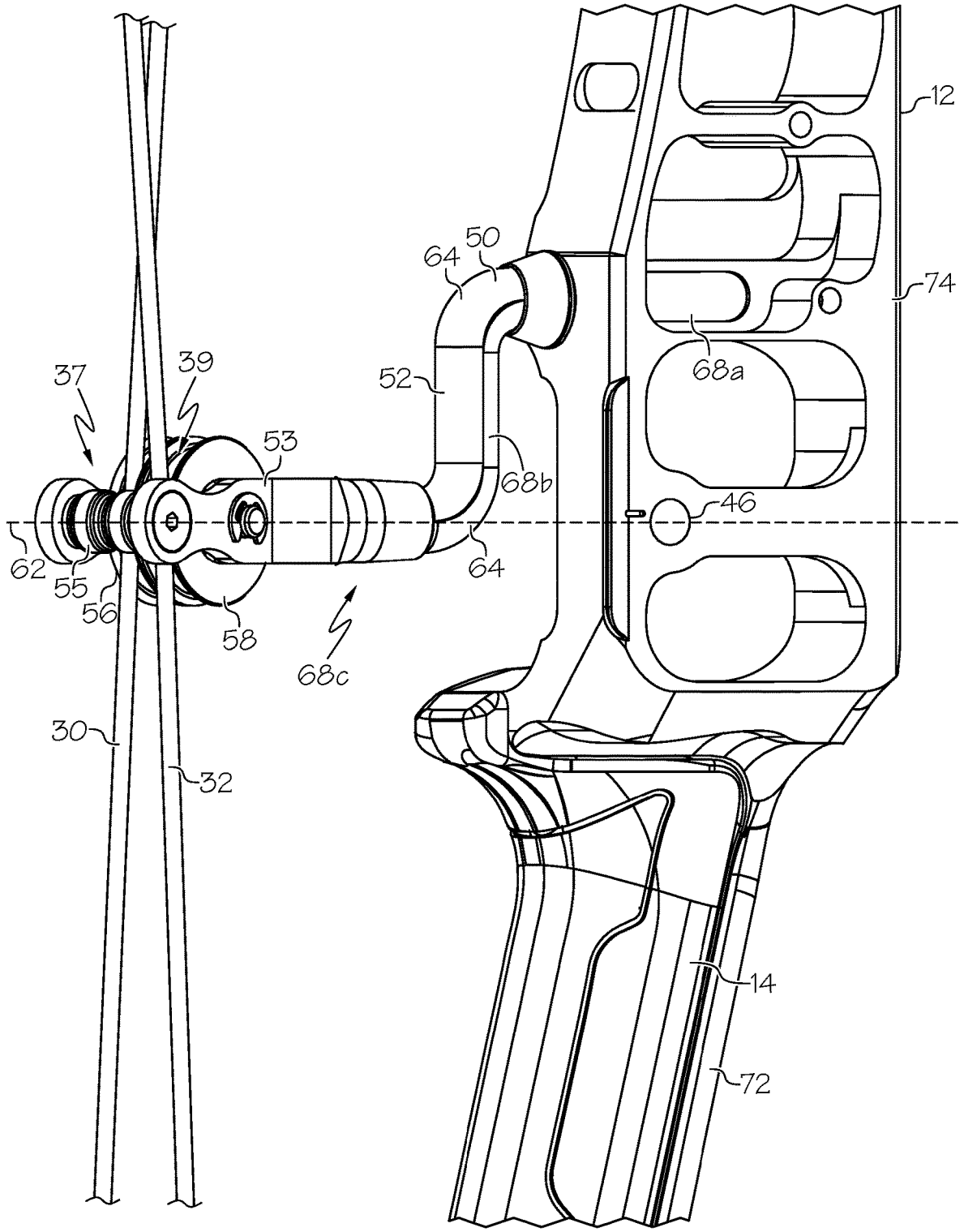
FIG. 9 shows an embodiment of a cable guard.

FIG. 8 shows another embodiment of an archery bow 10 comprising another embodiment of a cable guard 50. FIG. 9 shows the embodiment of the cable guard 50 in greater detail.

In some embodiments, a cable guard 50 comprises a body member 52 comprising curvature along its length. In some embodiments, a body member 52 comprises one or more curved portions 64, wherein a longitudinal axis of the body member 52 comprises curvature. In some embodiments, a body member 52 comprises one or more straight portions 68 wherein a longitudinal axis of the body member 52 is straight.

In some embodiments, a cable guard 50 comprises a body member 52 comprising a straight portion 68 oriented parallel to the shooting axis 40. In some embodiments, a straight portion 68 is oriented in the lateral plane 62. In some embodiments, a straight portion 68*a* is offset from the lateral plane 62 and extends parallel to the lateral plane 62. In some embodiments, a straight portion 68*b* is oriented orthogonal to the lateral plane 62. In some embodiments, a first straight portion 68*a* is offset from and parallel to the lateral plane 62 and a second straight portion 68*b* is orthogonal to the lateral plane 62. In some embodiments, the first straight portion 68*a* and the second straight portion 68*b* are attached by a curved portion 64. In some embodiments, a third straight portion 68*c* is oriented in the lateral plane 62. In some embodiments, the first straight portion 68*a* extends parallel to the third straight portion 68*c*. In some embodiments, the second straight portion 68*b* and the third straight portion 68*c* are attached by a curved portion 64. In some embodiments, the first straight portion 68*a* is attached to the riser 12. In some embodiments, the third straight portion 68*c* is attached to a housing 53.

In some embodiments, a cable guard 50 comprises a housing 53 and a cable retainer 55, for example as described in U.S. Pat. No. 9,829,269. In some embodiments, the cable retainer 55 is oriented in the lateral plane 62. In some embodiments, the cable retainer 55 comprises a central axis, and the central axis is located in the lateral plane 62.

Figure 10:
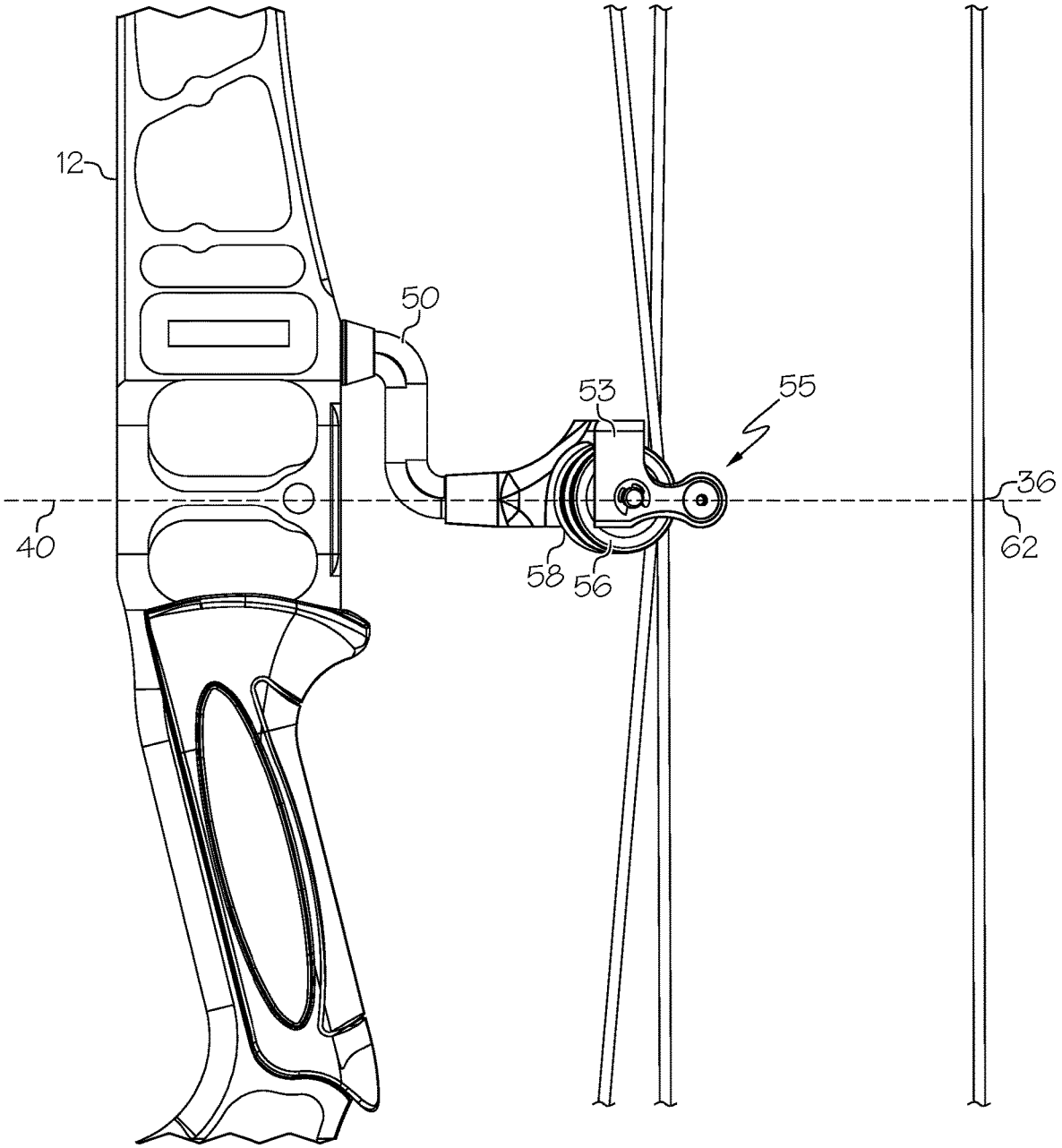
FIG. 10 shows another embodiment of a cable guard.

FIG. 10 shows another embodiment of a cable guard 50, showing an alternative housing 53 arrangement. When compared to the embodiment of the housing 53 shown in FIG. 8, the housing 53 of FIG. 10 provides more room for arrow clearance. The housing 53 of FIG. 8 contains structure that extends closer to the shooting axis 40 and longitudinal plane 66 (see FIG. 4) than the housing of FIG. 10.

In various embodiments, a housing 53 can have any suitable shape. A person of ordinary skill in the art will recognize the need for components located near the shooting axis 40, such as the cable guard 50, to provide suitable clearance to allow arrows and fletching to pass without contact.

Figure 11:
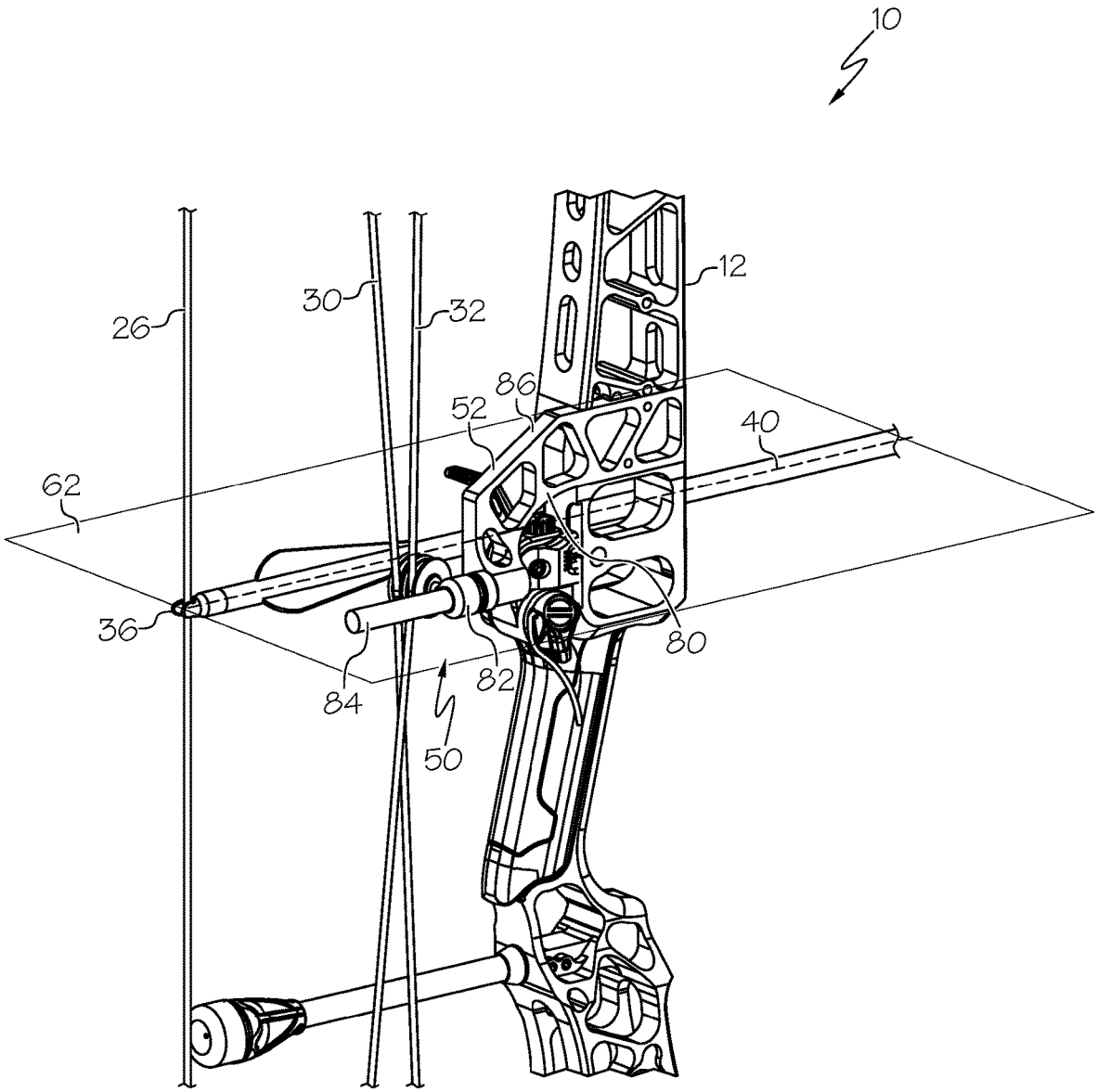
FIG. 11 shows another embodiment of a cable guard.

FIG. 11 shows another embodiment of a cable guard 50. In some embodiments, the cable guard 50 comprises a body 52 comprising a first portion 80 and a second portion 82. In some embodiments, the second portion 82 is moveable with respect to the first portion 80. In some embodiments, the first portion 80 is attached to the riser 12 and the second portion 82 contacts the first cable 30. In some embodiments, the second portion 82 contacts the second cable 32.

In some embodiments, the second portion 82 is moveable with respect to the riser 12. In some embodiments, the second portion 82 is oriented in the lateral plane 62. In some embodiments, the second portion 82 is arranged to move along an axis oriented in the lateral plane 62.

In some embodiments, the first portion 80 comprises a shaft 84. In some embodiments, the shaft 84 is oriented in the lateral plane 62. In some embodiments, a central axis of the shaft 84 is oriented in the lateral plane 62. In some embodiments, a central axis of the shaft 84 extends parallel to the shooting axis 40. In some embodiments, the second portion 82 is arranged to move along a length of the shaft 84. In some embodiments, the first portion 80 comprises a bracket 86. In some embodiments, the bracket 86 is attached to the riser 12 and the shaft 84 is attached to the bracket 86.

Figure 12:
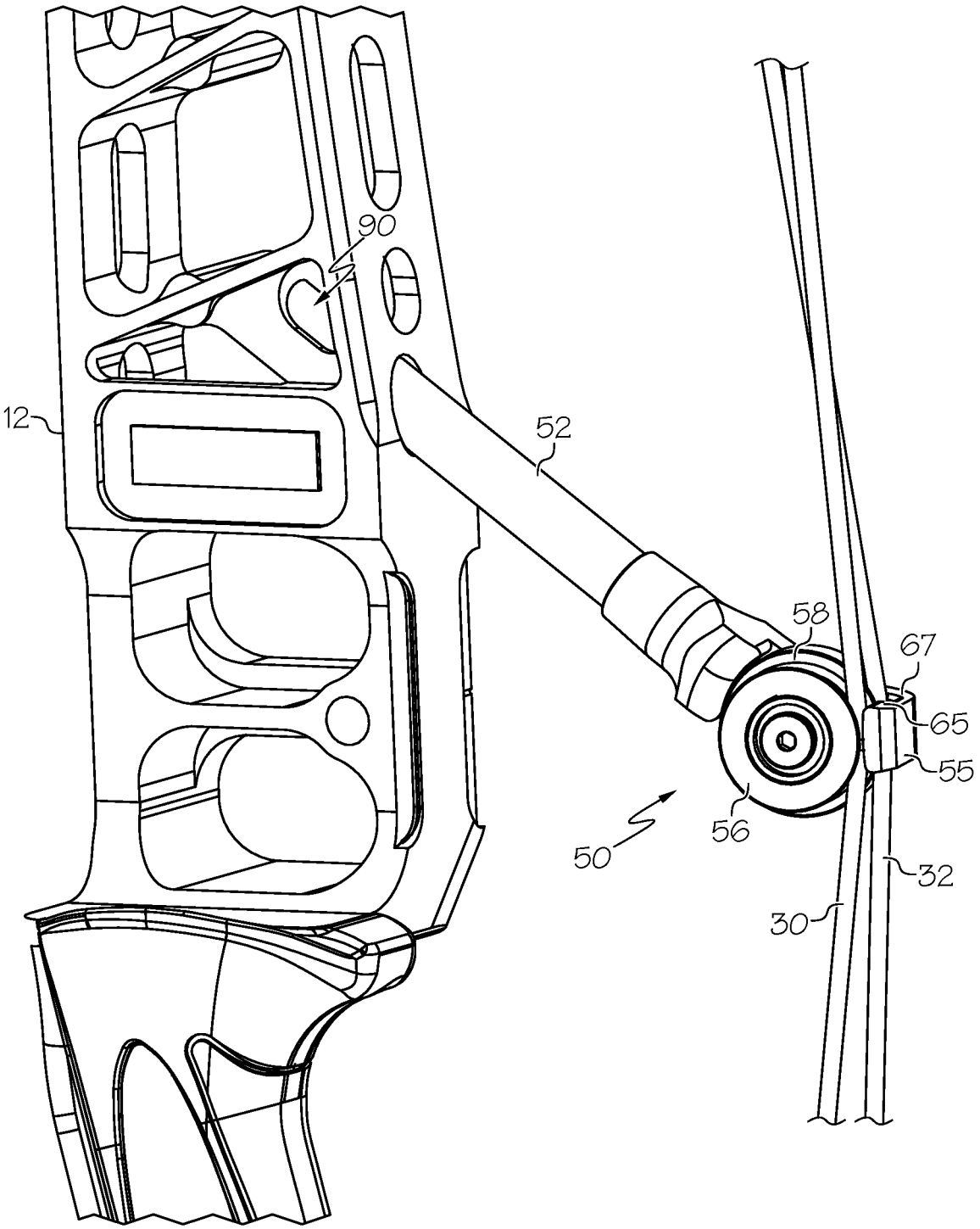
FIG. 12 shows another embodiment of a cable guard.

FIG. 12 shows another embodiment of a cable guard 50. In some embodiments, a first roller 56 comprises a different size than a second roller 58. For example, in some embodiments, a first roller 56 comprises a smaller diameter than the second roller 58. In some embodiments, a center of the first roller 56 is located a different distance from the riser 12 than a center of the second roller 58. In some embodiments, a contact point between the first roller 56 and the first cable 30 is located the same distance from the riser as a contact point between the second roller 58 and the second cable 32.

In some embodiments, a cable guard 50 comprises a cable retainer 55 arranged to prevent disengagement of the cables 30, 32 from the respective rollers 56, 58. In some embodiments, a distance between a roller 56, 58 and the cable retainer 55 is less than a diameter of a cable 30, 32. In some embodiments, the cable retainer 55 comprises a first portion 65 adjacent to the first roller 56 and a second portion 67 adjacent to the second roller 58. In some embodiments, the first portion 65 is offset from the second portion 67.

Figure 13:
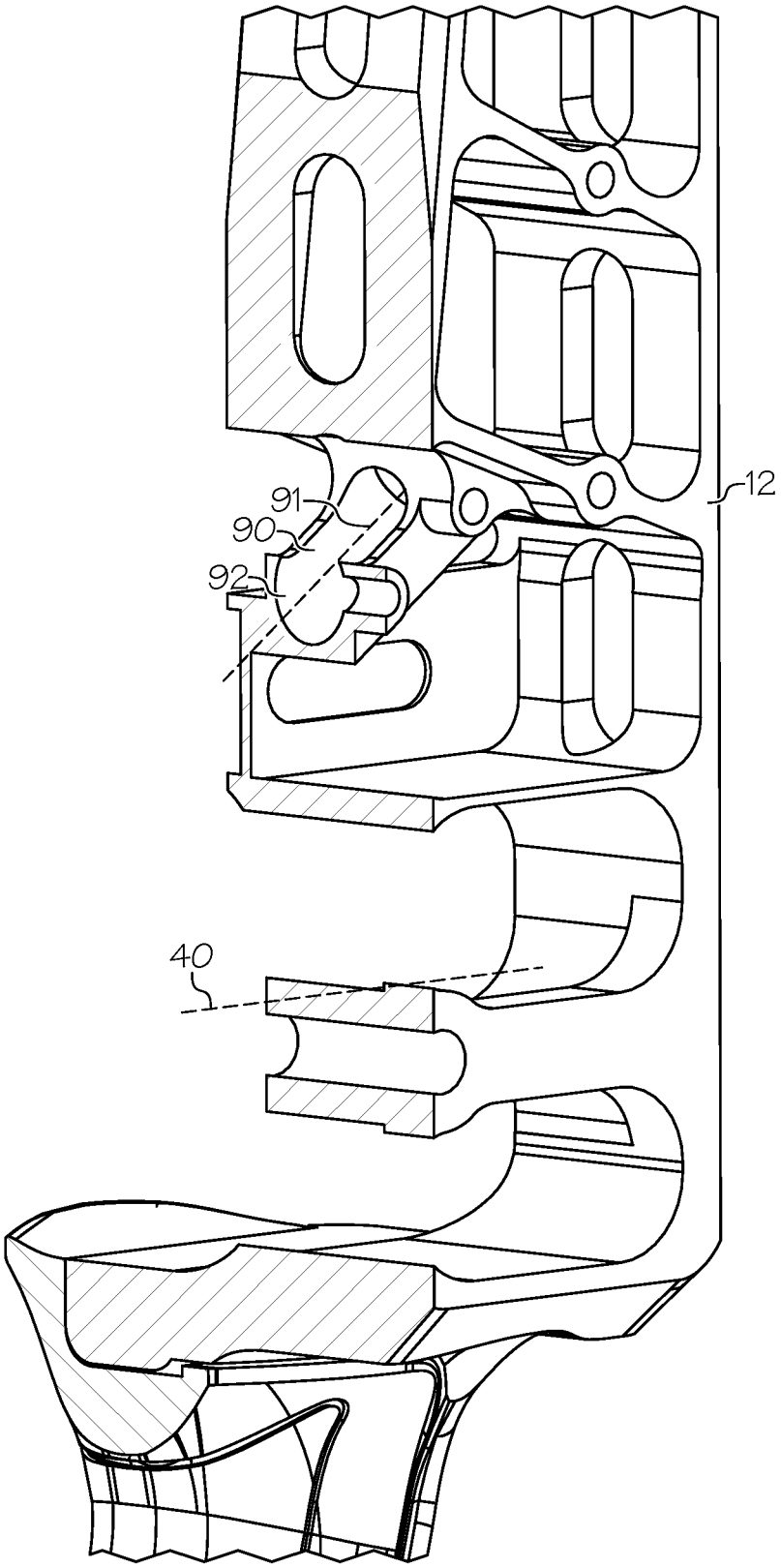
FIG. 13 shows a section view of an embodiment of a riser.

With reference to FIGS. 12 and 13, in some embodiments, the riser 12 comprises a cavity 90 arranged to receive the cable guard 50. In some embodiments, the cavity 90 comprises a central axis 91. In some embodiments, the central axis 91 is oriented at an angle to the shooting axis 40. In some embodiments, the riser 12 comprises a sidewall 92 that defines at least a portion of the cavity 90. In some embodiments, the sidewall 92 comprises an arcuate shape.

In some embodiments, an archery bow 10 comprises a handheld bow or a vertically oriented bow. In some embodiments, the archery bow 10 is not a crossbow and does not include a stock, string latch or trigger.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser comprising a grip and a cavity;

a bowstring comprising a nocking point;

a cable;

a cable guard arranged to apply a lateral force to the cable at a contact location, the cable guard comprising a body member attached to the riser at an attachment location, the body member comprising a longitudinal axis;

the bow defining a shooting axis, the shooting axis positioned in a longitudinal plane and a lateral plane, the longitudinal plane orthogonal to the lateral plane, the bowstring positioned in the longitudinal plane, the grip oriented below the lateral plane, the attachment location oriented above the lateral plane, the longitudinal axis oriented at a non-zero angle to the lateral plane, the cable guard biasing the cable laterally away from the longitudinal plane, the cavity comprising a central axis oriented at a non-zero angle to the shooting axis, a portion of the body member oriented in the cavity.

2. The archery bow of claim 1, the body member comprising curvature along its length.

3. The archery bow of claim 1, the cable guard comprising a cable engaging member arranged to move with respect to the body member.

4. The archery bow of claim 3, the cable engaging member arranged to move parallel to the shooting axis.

5. The archery bow of claim 1, the cable guard comprising a roller arranged to contact the cable.

6. The archery bow of claim 5, a rotation axis of the roller oriented in the lateral plane.

7. The archery bow of claim 1, the cable comprising a first cable, the contact location comprising a first contact location, the archery bow comprising a second cable, the cable guard arranged to apply a force to the second cable at a second contact location.

8. The archery bow of claim 7, the second contact location positioned on the lateral plane.

9. The archery bow of claim 7, the cable guard comprising a first roller arranged to contact the first cable.

10. The archery bow of claim 9, the cable guard comprising a second roller arranged to contact the second cable.

11. The archery bow of claim 10, the first roller and second roller positioned on a common rotation axis.

12. The archery bow of claim 10, a rotation axis of the first roller offset from a rotation axis of the second roller.

13. The archery bow of claim 1, the grip oriented upon the longitudinal plane.

14. The archery bow of claim 1, the riser comprising a Berger button hole oriented on the lateral plane.

15. The archery bow of claim 1, comprising a first rotatable member arranged to rotate about a first axis and a second rotatable member arranged to rotate about a second axis, wherein the lateral plane is located midway between the first axis and the second axis.

16. The archery bow of claim 1, the cavity comprising an arcuate sidewall.

17. An archery bow comprising:

a riser comprising a grip and a cavity comprising a longitudinal axis;

a bowstring comprising a nocking point;

a cable;

a cable guard arranged to apply a lateral force to the cable, the cable guard comprising a body member attached to the riser, a portion of the body member oriented in the cavity;

the bow defining a shooting axis, the shooting axis positioned in a longitudinal plane and a lateral plane, the longitudinal plane orthogonal to the lateral plane, the bowstring positioned in the longitudinal plane, the longitudinal axis oriented at a non-zero angle to the lateral plane, the cable guard biasing the cable laterally away from the longitudinal plane.

* * * * *